United States Patent [19]

Fallon

[11] Patent Number: 4,509,663

[45] Date of Patent: Apr. 9, 1985

[54] LOCKING MECHANISM AND VALVE ASSEMBLY

[75] Inventor: Merton R. Fallon, Thousand Oaks, Calif.

[73] Assignee: Draft Systems, Inc., Northridge, Calif.

[21] Appl. No.: 361,975

[22] Filed: Mar. 29, 1982

[51] Int. Cl.[3] ..... B65D 83/00

[52] U.S. Cl. ..... 222/400.7; 137/212

[58] Field of Search ..... 137/212, 322; 251/149.6; 222/400.7, 400.8

[56] References Cited

U.S. PATENT DOCUMENTS

| | | | |
|---|---|---|---|
| 3,599,843 | 8/1971 | Johnston | 222/400.7 X |
| 3,720,355 | 3/1973 | Johnston | 222/400.7 |
| 4,159,102 | 6/1979 | Fallon et al. | 137/212 X |

*Primary Examiner*—Stanley H. Tollberg
*Attorney, Agent, or Firm*—James E. Brunton

[57] ABSTRACT

An improved locking mechanism and valve system for obtaining access to a container of fluid. In a container of fluid, and particularly a keg for beer, a valve assembly receiving member or keg neck extends from the top of the container. A sealing mechanism is provided to secure the valve assembly in sealed relationship with the keg neck and to allow access to the fluid contained by actuation of the valves. More specifically, the valve neck has a groove in its inner surface to receive a resilient retainer ring which maintains the valve assembly in place. In addition, an improved dual keyway, dual key safety feature is provided to prevent inadvertent expulsion of the valve assembly should the retainer ring be dislodged while the keg is pressurized. This improvement also decreases the likelihood of damage to the valve assemblies during their installation and precludes accidental or intentional infliction of damage to the safety keys carried by the valve body of the system. Further the improved configuration of the valve assemblies prevents catastrophic failure of the systems in the event of fire or exposure of the system to high temperature environments. Finally, the design of the valve system has been improved to enhance fluid flow therethrough and to enable superior cleaning of the system components.

11 Claims, 6 Drawing Figures

FIG. 1.
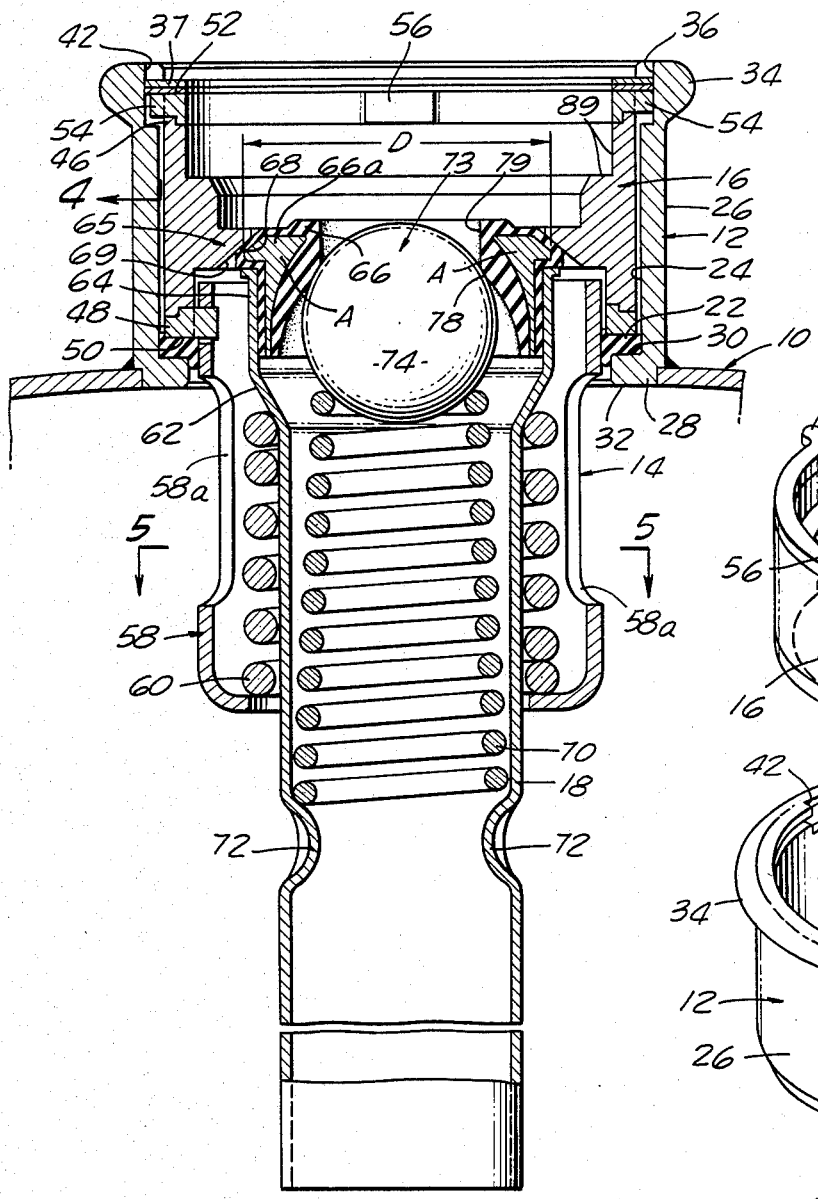
FIG. 2.
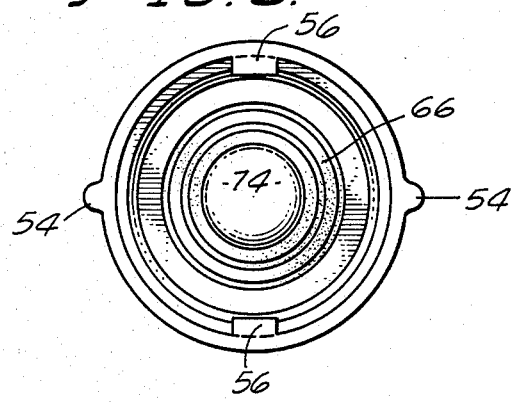
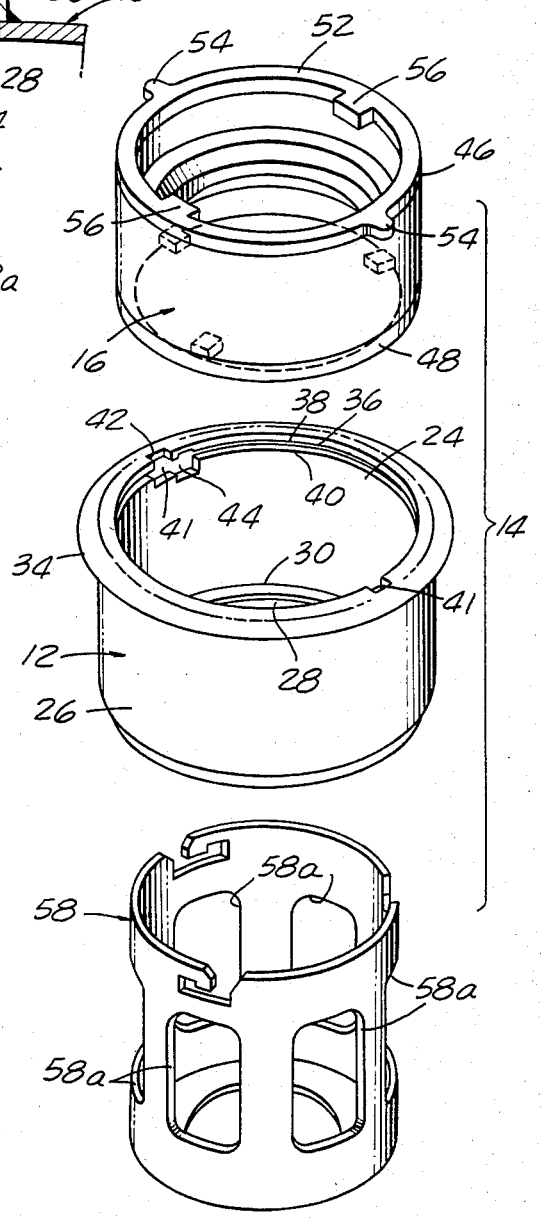
FIG. 3.

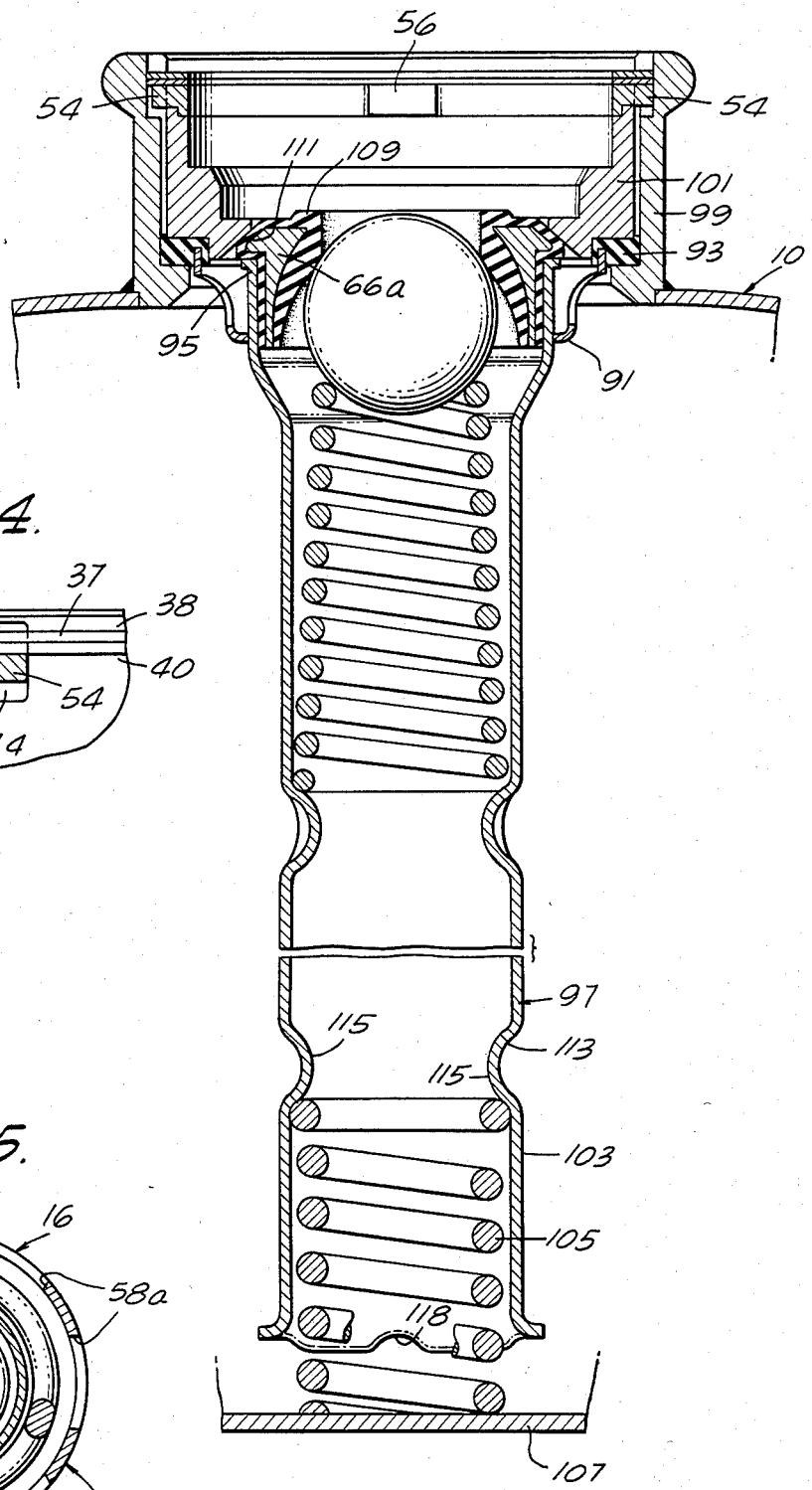
FIG. 6.
FIG. 4.
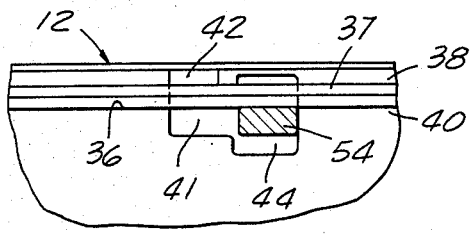
FIG. 5.
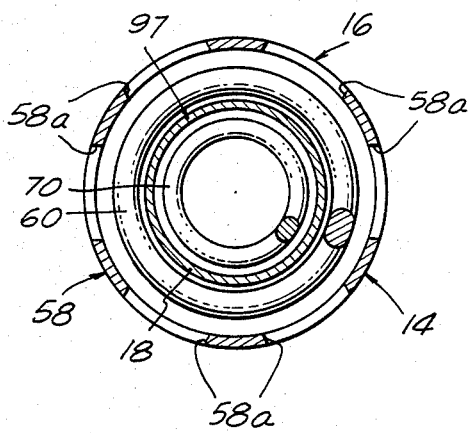

LOCKING MECHANISM AND VALVE ASSEMBLY

BACKGROUND OF THE INVENTION

In systems for tapping kegs of fluid and particularly containers of beer there has been used a valve assembly secured to the top of the keg for providing access to the fluid ultimately to be delivered from the keg to a remote position for distribution. Typically, the valve assembly includes a dual valve arrangement with a siphon tube which extends from the valve assembly to the bottom of the keg. The valve assembly is fixed within the keg neck or other valve receiving member to provide a valved system, when tapped by a coupler or some other keg tapping means connected to a pressure source, allows pressurized gas to flow into the keg until the desired pressure within the keg is achieved to force the fluid out of the keg through the valve system and ultimately to a distribution device where the fluid can be used to fill glasses and the like. The valve system is one which allows the pressurized gas, usually carbon dioxide, to be forced into the keg but only allows the fluid to be forced out of the keg to distribution device until the keg is extirely emptied of fluid.

The valve assembly includes a body portion which carries an O-ring in sealing engagement with the keg neck to prevent leakage along the interface between the valve body and the neck. To achieve the seal, the O-ring is maintained in a deformed disposition between two metal shoulders of the valve body portion and the keg neck. In many prior art devices, metal shoulders are moved toward each other to compress the O-ring seal by a threaded fitting threadedly engaged with the keg neck. As the threaded fitting is turned down, the shoulders rotate relative to each other and simultaneously move downwardly lineally to deform the O-ring between the valve body and the keg neck. The more the fitting is rotated, the more lineal thrust is imparted to the O-ring deforming it even further.

The problem with this approach is that there is no effective way to limit the compression imparted to the sealing ring. Without such a limitation the sealing ring can be over compressed where it will be subjected to "compression set" in which case the seal will not return substantially to its uncompressed state when the lineal thrust is reduced. This detracts from the ability of the O-ring to maintain its sealing characteristics over a long period of time. Also, the sealing ring may be damaged by action of the shoulders rotating against the surface of the seal thereby negating its sealing properties.

Besides the loss in the efficacy of the seal due to overcompression or damage caused by the rotation by two metal parts, the threads can be loosened after continued use allowing the seal to be violated inadvertently. In addition, a rotation movement is usually employed in attaching a tapping member or a coupler to the valving system. Where threaded fittings are used it is quite easy for the turning of the tapping devices to also rotate the threaded fittings thereby unscrewing one fitting relative to the other moving it lineally away from the O-ring allowing the seal to be violated.

Some prior art valve assemblies used with kegs have included a dual valve system having two valve members each biased into engagement with its respective valve seat. To bias at least one of the valve members, a helical spring circumscribing the siphon tube is utilized. A spring retaining cup is used to hold the helical spring in place with sufficient compression to maintain the valve in a normally closed position. The cup extends downwardly from the valve body about the helical spring and has a radially projecting surface extending inwardly toward the siphon tube to support the bottom of the spring. By having the helical spring disposed in this manner, it becomes difficult to clean allowing residue to build up in the spring coils. Because the cleaning fluids are injected under pressure through the valves, the location of the helical spring adjacent the siphon tube is one which is not readily accessible to the path taken by pressurized cleaning fluid. In addition, by being enclosed by the cup portions, the coils of the spring are not sufficiently exposed to receive the full effect of the cleaning fluid. Where the residue is not completely cleaned away, it can adversely affect the quality of fluid added to the keg for later distribution.

With regard to the coupler or other tapping mechanism, they are inserted by rotation into the valve assembly. Then by separate action, the handle is actuated to open the valves and permit the flow of fluid into and out of the keg in the appropriate channel. After the fluid has been completely dispersed from the keg, the reverse sequence is followed to reseal the valves. If the aforementioned sequence is followed, there will be no loss of fluid or gas in the tapping or untapping procedure.

However, if the handle is inadvertently placed in the tapped or valve open position prior to attaching the coupler to the valve assembly, the valves will be moved to an open position before the coupler is fully in place allowing some leakage to occur until the coupler rotated sufficiently to seal the interface between the coupler and valve assembly. Similarly, if the handle is not relocated to close the valves prior to untapping, leakage will occur until the coupler is rotated out of the valve assembly to a position where the valves reach their naturally closed position. Particularly where the keg contains toxic or otherwise dangerous fluid, the leakage occurring from failure to follow the correct tapping and untapping procedure consitutes a physical danger to the operator. For example, where the keg contains concentrated agricultural chemicals, such as pesticides, insecticides, fertilizer, etc., leakage of these chemicals through an improper coupling technique can be seriously deleterious to the health of the operator.

One of the most effective systems ever devised to overcome the drawbacks of the prior art is described in U.S. Pat. Nos. 4,159,102 and 4,181,143. Broadly stated the systems described in these patents provided better sealability between movable parts to prevent unnecessary leakage, safer operability to protect the operator even from his own errors, and constructional features facilitating cleaning operations and economic savings in manufacturing and assembly, among others.

With regard to the sealing features, the inventions described in the aforementioned patents relate to imparting lineal thrust against a deformable sealing member between two surfaces substantially without relying on rotation. This allows better tolerances to maintain the seal over long periods of time and to avoid inadvertent violation of the seal due to operation of the valve system in tapping and untapping procedures. In addition, the systems are easy to install and provide substantial safety advantages over the systems which have characterized the keg tapping systems of the past.

However, the systems described in U.S. Pat. Nos. 4,159,102 and 4,181,143 exhibit certain drawbacks. For example, the devices of these patents include anti-rotational or locking lugs which act as a time delay mechanism to preclude releasing of the coupler from the keg neck while pressure remains within the vessel. It has been found through usage that, because of the particular location of the counter rotational lugs on these devices it is possible for an operator to unwittingly, or intentionally to attack the locking lugs with a chisel, screwdriver or the like so as to deform or dislodge one or both of the lugs and at the same time damage the adjacent key which forms a critical aspect of the safety time delay feature of the devices. In the devices of the present invention a second key has been added and the locking lugs have been relocated 90 degrees from the keys so that the keys are no longer accessible to the unwitting, or even the intentional, cause of damage or sabotage. This relocation of the locking lugs adds substantially to the inherent safety of the time delay mechanism technique suggested in the aforementioned patents.

The addition of the second key also substantially enhances the overall safety of the system due to the fact that when the valve assemblies are installed with an automatic pressure device, a single lug can be deformed or sheared during the installation process. By doubling the number of safety keys, the shearing forces required during installation to cause or create an unsafe circumstance are effectively doubled. Such a vast increase in the available thrust force from an installation tool is not within the installers adjustment range thereby making damage to the safety keys highly unlikely.

Another drawback to the devices of the previously identified patents resides in the construction of the valve insert which was encapsulated in the first valve member of the dual valve system. This valve insert being a stamped insert of uniform wall thickness, fails to provide the required system safety in the event of fire and other castastrophic events. For example, where the system is exposed to high temperatures such as a building fire or the like, the rubber coating surrounding the valve insert will degrade while at the same time excessive internal steam pressures are building up on the keg tending to force the thin walled stamped valve liner or insert to extrude itself through the heavy walled fixed diameter opening in the keg neck. This, of course, creates an extremely hazardous situation. In the improved system disclosed herein the valve insert is reconfigured and the wall thickness thereof has been selectively increased to the point where it will withstand internal pressures in excess of 4000 psi and temperatures in excess of 3000° before any deformation of the metal-to-metal interfering components can begin. Since fires in beverage dispensing establishments are a reasonably predictable circumstance, this reconfiguration of the valve insert is considered to be a material improvement in the safety aspects of the system and its use.

Still another improvement in the prior art systems resides in the redesign of the spring retainer basket to permit a higher rate of undisturbed flow of fluid, either cleaning fluid or beverages, through the basket. More specifically the spring retainer basket has been redesigned to provide six, rather than four, strategically located fluid flow apertures in the side walls of the basket.

SUMMARY OF THE INVENTION

It is an object of the present invention to substantially improve the safety and dependability of the devices described and claimed in U.S. Pat. Nos. 4,159,102 and 4,181,143 and to overcome the drawbacks of these devices enumerated in the previous paragraphs.

More particularly it is an object of the invention to redesign the valve assemblies of the previously described systems in a manner which will prevent accidental, or intentional, damage and sabotage to the safety keys which form a critical part of the safety delay means of the systems. Additionally, it is an object of the invention to modify the number and location of the keys to minimize the possibility of damage to the system during installation of the valve assemblies with automatic pressure devices.

Another object of the invention is to modify the configuration of the valve assemblies of the system to improve fluid flow characteristics and thereby enhance both the operation of the devices and the ability to effectively clean the devices with external cleaning fluids introduced under pressure through the valve assemblies.

Yet another object of the invention is to redesign the first valve member insert of the previous devices in a manner to prevent catastrophic failure of the system in case of fire or exposure to high temperature environments.

A still further object of the invention is to redesign the valve components to increase safety and to facilitate ease of assembly and disassembly of the valve body with the keg neck.

Another object of the invention is to arrive at an economical device whose parts are simple to manufacture but still achieve the tolerances necessary for sealing and avoid the complexity which has characterized such devices in the past to enhance the repeatability and extend the life of the device.

BRIEF DESCRIPTION OF THE DRAWINGS

FIG. 1 is a cross-section of the valve assembly as secured within a neck extending from the top portion of a container.

FIG. 2 is a top view of the valve assembly removed from the valve neck.

FIG. 3 is an exploded perspective view of the keg neck shown in FIG. 1 and the valve body and spring retainer cup portions of the valve assembly.

FIG. 4 is a fragmentary cross-sectional view taken along Lines 4—4 of FIG. 1 showing the valve assembly in a locked position within the keg neck.

FIG. 5 is a cross-sectional view taken along lines 5—5 of FIG. 1.

FIG. 6 is a cross-sectional view of another embodiment of a valve assembly secured within the valve neck extending from the top of a container.

DETAILED DESCRIPTION OF ONE FORM OF THE INVENTION

Referring to FIG. 1 there is shown a keg 10 with a neck 12 affixed to the top of the keg by welding. Secured within this neck is a valve assembly 14 which includes a valve body 16 having a siphon tube 18 extending from the bottom of the keg. A coupler assembly of the type illustrated and described in U.S. Pat. No. 4,159,102 is secured to the valve assembly 14 in a manner which allows pressure to be imparted through the coupler assembly to the interior portions of the keg for pressurizing the liquid therein which in this case is beer and also provides an outlet for the liquid to a conduit downstream of the coupler assembly. The description of the coupler assembly as set forth in U.S. Pat. No. 4,159,102 is incorporated herein by reference.

Because the valve assembly 14 and the neck 12 are separate and independent parts a seal is provided between them to insure that the fluid under pressure as well as the gas providing the pressure does not leak between the joints of the valve assembly and the neck. To this end a deformable O-ring 22 is secured between the keg neck 12 and the valve assembly 14 at the appropriate place to prevent any such leakage. The valve neck 12 is generally cylindrical having an inner surface 24 and an outer surface 26. An annular ring 28 extends radially inwardly from the inner surface of the bottom portion of the valve neck 12. This annular ring 28 has an upper surface 30 for engaging a portion of the deformable O-ring 22 and a lower surface 32 which is welded adjacent to the top of the keg. The top portion of the neck 12 defines a bushing 34 which has a groove therein 36 extending entirely around the circumference of the inner surface 24 for receiving resilient retainer ring 37. This groove 36 has an upper lip 38 and a lower lip 40 (FIG. 3) which engage the upper and lower portions respectively of the resilient retainer ring 37.

An important feature of the improved valve assembly and valve assembly receiving member of the present invention resides in the diametrically opposed, uniquely configured keyways 41 formed in the valve assembly receiving member or keg neck 12. These keyways 41 are of identical construction and are adapted to lockably receive diametrically opposed keys 54 provided on the upper portion of valve body 16. As best seen in FIG. 3, each keyway 41 includes a first recessed area 42 which communicates with the top portion of the neck 12 through the upper lip 38 of the groove 36, with the lower lip 40 of the groove 36 providing the lower boundary of the first recessed area 42. A second recessed area 44 communicates with the lower lip 40 of the groove 36 and extends downwardly therefrom and is offset circumferentially from the first recessed area 42 and is bounded at its upper limit by the upper lip 38 of the groove 36. In this way movement through the keyway 41 defines a path that is vertically downward and then laterally through the groove 36 until the second recessed area 44 is reached and then downwardly again.

The valve assembly of this improved construction includes a valve body 16 which has an upper portion 46 and a lower portion 48. The lower portion 48 has a bottom complementary seal engaging surface 50 which presses against O-ring 22 when the valve body 16 is in the retained position within the neck 12. The upper portion of the valve body 16 includes a retainer ring engaging surface 52 which, as can be seen in FIG. 1, engages the resilient retainer ring 37 thereby maintaining the valve body in the desired position within the valve neck and compressing the O-ring for achieving the seal between the valve body 16 and the neck 12.

A feature of the above-described arrangement for deforming the O-ring 22 between the valve assembly 14 and the keg neck 12 is the ability to control the tolerances between these elements to insure that the O-ring 22 is sufficiently deformed to provide sealing and also to avoid overcompression of the O-ring 22 so that it is not subject to "compression set".

More specifically, the O-ring has a cross-sectional diameter in its free state which is approximately 0.140 inches. When the O-ring 22 is compressed to a rectangular cross-section as illustrated in FIG. 1, the rectangular dimension measured vertically is approximately 0.109 inches; meaning that the lineal thrust has been accomplished through a distance of 0.031 inches or 21.5% of its free state dimension. This distance of 0.031 inches is a substantial one that can be worked with very comfortably in dealing with machine tolerances. In other words, the dimensions between the groove and the surfaces for compressing the O-ring 22 can be defined well within a range to achieve the deformation for sealing without literally compressing the material resulting in "compression set".

The previously identified keys 54 extend from the upper portion of the valve body 16 for engagement with the keyways 41 provided in the neck 12. Each key 54 extends sufficiently into its respective recessed areas 42, 44 to allow for movement within the recessed areas 42, 44, but is restrained from movement beyond the boundaries defining the keyways 41. With this configuration the keys 54 can simultaneously be moved vertically to the lower lip 40 in the first recess area 42, laterally along the groove 36 connecting the recessed areas 42, 44 and downwardly into the second recessed area 44. In this way, to place the valve body 16 into the neck 12 so that the retaining ring 37 can be placed within the groove 36, the valve body 16 must initially be rotated to a position where each key 54 registers with its respective first recessed area 42. In this position, the valve body can be lowered downwardly until the keys 54 abut the lower lip 40 of the groove 36. The valve body 16 is then rotated until the keys 54 register with their respective second recessed area 44 at which point the valve body 16 can be lowered further until the retainer ring engaging surface 52 of the valve body is sufficiently below the groove 36 to allow insertion of the retainer ring 37 for holding the valve body 16 in position (see FIG. 4).

With this configuration, the only way the valve body 16 can be removed is by first removing the retainer ring 37 which is difficult without the proper tools, and then rotating the valve body 16 to the correct position within the keyways 41 allowing it to be removed. This provides a safety mechanism to prevent expulsion of the valve assembly 14 upon inadvertent removal of the retaining ring 37.

Should the retaining ring 37 be inadvertently removed for some reason while the keg 10 is pressurized, the valve body 16 will tend to remain in place because the upward pressure of the gas on the valve assembly 14 will force the valve body 16 slightly upwardly to a position where the keys 54 engage the upper lip 38 of the groove 36 above the second recessed area 44. The only way the valve assembly 14 can be removed thereafter is by intentionally rotating it to a position where each key 54 registers with its respective first recessed area 42. By this time, the seal has been broken, equalizing the pressure in the keg, thus eliminating the danger of the valve assembly 14 being expelled forcibly. In any event, removal of the valve assembly can only be accomplished through intentional rotation through a path defined by the keyways 41.

A drawback of the structure shown in U.S. Pat. No. 4,159,102 was the fact that as previously described, during the interconnection of the valve body with the keg neck the single key 54 provided on the valve body could, through carelessness, be damaged and structurally weakened. With this single key construction, if the key was sheared or weakened, removal of the retaining ring 37 could cause the valve assembly to be expelled explosively from the container. By doubling the number of keys 54 the important time delay feature of the invention is assured since the likelihood of both keys being damaged simultaneously is quite remote. Accordingly, the undamaged key can preserve the important safety feature of the invention until the damage is discovered and the defective valve body is replaced. Additionally, the second key 54 provides even a further safety feature in that, when the valve assembly is installed with an automatic pressure device, a single key can be deformed or sheared during the installation process and the forces required to shear a single key are attainable within some reasonable adjustment range from those forces required to apply sufficient thrust on the O-ring 22 so that an unsafe installation can reasonably be averted. By doubling the number of locking keys one can double the shearing forces required during installation to cause or create an unsafe circumstance.

Turning once again to FIG. 3 it can be seen that two lugs 56 extend radially inwardly from the top portion of the valve body 16. These lugs 56 provide a means for receiving and holding a coupler assembly of the type shown in FIG. 5 of U.S. Pat. No. 4,159,102 in place to provide pressure to the keg through the valve assembly 14 and provide a path out of the keg also through the valve assembly 14 to a position downstream where the fluid in the keg can be distributed.

Another important improvement of the structure of the present invention over that shown in U.S. Pat. No. 4,159,102 resides in the relocation of these lugs 56. In the structure of the aforementioned patent one lug 56 was in diametrical alignment with the single key 54. In the structure of the present invention the lugs 56 have been repositioned circumferentially 90 degrees so that neither lug 56 is in alignment with either key 54. This relocation is extremely important for in the construction of the patent it was possible for an operator to unwittingly, or intentionally attack the easily accessible locking lugs 56 with a chisel, or the like, so as to deform or dislodge one or both of the lugs 56. When the key 54 was aligned with one lug 56 deformation of the lug 56 could simultaneously cause damage to the key 54. Thereafter, the removal of the retaining ring 37 could cause the valve assembly to be expelled explosively from a pressurized keg thus creating an extremely dangerous situation. By moving the location of the locking lugs 56 around the circumference of body 16, the key 54 is not placed in jeopardy to the unwitting, or even the intentional, infliction of damage or sabotage. Such a relocation adds substantially to the inherent safety of the important time delay feature of the invention.

Referring once more to FIG. 1, the valve assembly 14 can be seen to comprise dual valves, namely a first valve 65 and a second valve 73 operating concentrically with each other about the axis of the siphon tube. Included with the first valve 65 is a spring retainer cup 58 for holding a helical compression external spring 60. The siphon tube 18 has a flared portion 62 near its top portion 64 which engages the top of the helical external spring 60. The bottom portion of the spring 60 rests on the bottom of the cup 58 as shown. The spring 60 is maintained between the bottom of the cup 58 and the flared portion 62 of the siphon tube 18 normally in a compressed position to bias the tube upwardly to maintain the first valve 65 is a normally closed position sealing annular first valve opening 69. A first valve member 66 is carried by the top portion 64 of the top of the siphon tube and engages a first valve seat 68. The helical spring 60 in its normal position maintains the engagement between the first valve member 66 and the valve seat 68 until the spring is compressed even further downwardly to allow displacement of the first valve member 66 away from the first valve seat 68 thereby opening the first valve 65.

The second valve 73 includes a second valve member 74 biased against a second valve seat 78 by an internal spring 70 to seal a second valve opening 79. Displaced from the top portion 64 of the siphon tube 18 are three circumferentially equidistant bulges 72 on the interior portion of the tube formed by impressing dimples on the exterior of the siphon tube 18. These bulges 72 provide a surface against which the bottom portion of the internal helical spring 70 rests. The top portion of the internal spring 70 engages the second valve member or ball 74 and presses it against the second valve seat 78 defined on the first valve member 66 as shown to maintain the second valve in a normally closed position. To open the second valve 73, the internal spring 70 is compressed allowing the ball 74 to be displaced from the second valve seat 78. In this way, the second valve closes and opens the opening 79 and the first valve 65 opens and closes the opening 69 which is concentric with opening 79.

As described in detail in U.S. Pat. No. 4,159,102 the coupler assembly cooperates with valve assembly 14 to open the passageways along the exterior portion and through the interior portion of the siphon tube by moving valve members 66, 74 away from the respective valve seat 68, 78. In summary, the coupler assembly has a coupler body with a wedge surface which is helical in configuration circumscribing the bottom of the coupler body for engaging the lugs 56 on the valve assembly 14. Slots are provided on either side of the coupler body through the wedge surface for allowing it to be inserted into the valve assembly 14 below the lugs 56.

Extending downwardly from the coupler body is a coupler elastic seal which registers with coupler sealing surface 89 defined in the valve body 16 (FIG. 1). Once the portion of the wedge surfaces adjacent the slots are in a position below the lugs 56, the coupler assembly can be rotated in a clockwise direction relative to the valve body. This rotation in conjunction with the interaction of the wedge surfaces with the lug 56 forces the coupler assembly downwardly pressing the coupler seal against the sealing surface 89 of the valve body 16. Further rotation compresses the coupler seal sufficiently to seal the interface between the valve body 16 and the coupler assembly.

The coupler assembly has a side fitting through which the gas is forced under pressure into the keg through the passageway formed when the first valve 65 is in the open position. The coupler body is a hollow cylinder having a probe movable therein between an open and closed position to actuate the valves 65, 73.

When the coupler assembly is engaged with the valve body the probe can be moved from a closed or retracted position where the valves remain closed to an open or extended position where the valves are opened allowing the flow of fluids in and out of the keg through the various passages in the coupler assembly. In the open position ball 74 is displaced from second valve seat 78 thereby opening the second valve 73 and allowing fluid under pressure to pass through the siphon tube 18 around ball 74 and out of second valve opening 79. Similarly, in the open position, the first valve member 66 is displaced downwardly away from the first valve seat 68 to open the first valve 65. In this open position the gas used to pressurize the keg is allowed to flow in the side fitting of the coupler, through the passageways in the coupler and then through the first valve opening 69 into the keg. As best seen in FIGS. 3 and 5, spring retainer cup 58 is provided with six apertures 58*a* in its side walls to permit pressurizing gas or, during cleaning operations, cleaning fluid, to flow freely into the keg. This six aperture configuration comprises another important improvement in the structure over that described in the patent wherein the fluid flow path through the cup was unduly restricted.

Still another important improvement in the apparatus of the present invention resides in the unique design of the valve member 66. In the construction illustrated in the patent the metal valve insert in the valve member 66 was a stamped insert of uniform wall thickness. Experience has shown that a substantial additional margin of safety is gained by making this stamped metal insert a machined or cast device of a modified frustoconical shape having non-uniform wall thickness, a major diameter "D" (FIG. 1) and of a specifically and intentionally heavy wall thickness in the area "A" (FIG. 1) where it physically contacts the valve seat. This provides an important safety feature in the circumstance where, through exposure to high temperatures such as a building fire, the rubber coating surrounding the valve insert would melt, while at the same time excessive internal steam pressures are built up in the keg tending to force the valve insert to extrude itself through the heavy walled fixed diameter opening in the valve body 16. In the improved construction illustrated in FIG. 1, the wall thickness of the valve insert 66*a* has been increased and the configuration modified so that the insert 66*a* will withstand internal pressures in excess of 4000 psi and temperatures in excess of 3000° before any deformation of the metal-to-metal inferfering components can begin. Since fires in beverage dispensing establishments are a reasonably predictable circumstance, this is considered to be a material improvement in the safety aspects of the improved apparatus of the invention as described herein.

Another embodiment including a valve assembly for use with a keg neck to gain access to the fluid within a keg is shown in FIG. 6. The valve assembly as shown in FIG. 6 is substantially identical to that as shown in FIG. 1 except for modifications which will be more fully explained hereinafter.

For example, instead of having a spring circumscribing the siphon tube and being contained by a rather large retainer cup, the embodiment of FIG. 6 includes a small retainer cup 91 secured to seal 93. A flange 95 extends from the top portion of siphon tube 97 entirely around its periphery. The smaller retainer cup 91 extends from the seal 93 to a position sufficiently close to the exterior surface near the top portion of the siphon tube 97 for engaging flange 95. The sealing member 93 is retained in a position between a neck 99 and a valve body 101 in a manner similar to that described in connection with FIG. 1. It should be noted that because a large part of the spring and retainer cup construction has been eliminated in the area adjacent the valve neck, the valve neck 99 and valve body 101 of this embodiment does not require the same dimensions as the device of FIG. 1. As shown in FIG. 6, this embodiment employs a valve neck and valve body which has a height dimension less than that of the corresponding elements in FIG. 1.

The siphon tube 97 has a bottom portion 103 which carries a major spring 105 in a generally compressed disposition against the keg bottom 107 to maintain the first valve member 109 biased against the valve seat 111 carried by the valve body 101 in a manner similar to that described in connection with FIG. 1. More particularly, dimples 113 adjacent the bottom portion 103 are formed in the sides of the siphon tube 97 to provide bulges 115 on the inside of the siphon tube against which the top of a major spring 105 can press. The bottom of the spring 105 rests against the bottom of the keg 107. In a normal disposition, the spring is maintained compressed between the dimples 113 and the bottom of the keg 107 to force the siphon tube 97 and the valve member 109 that it carries against the valve seat 111.

The bottom portion 103 has four flared portions 118 equally spaced as can be seen in FIG. 6. These flared portions insure that cleaning fluid or other fluids inserted through the siphon tube will be equally distributed along the bottom of the keg as well as the remaining portions of the keg. In addition, the flared portions insure that any undue extension of the siphon tube which may cause the bottom portion to engage the bottom of the keg in a flush position will not impair the flow of fluid through the siphon tube since access thereto can still be had through the flared portions 118.

Also, by having the spring located within the bottom portion 103 during the washing and cleansing cycle when cleansing fluid is inserted through the valve assembly, and through the internal portions of the siphon tube, both springs will be completely washed by the fluid forced into the siphon tube under pressure. This insures that residue will not accumulate on the springs which accumulation may have an adverse effect on fluids that are ultimately added to the keg. In addition, the large retaining cup can be eliminated substantially reducing the cost of manufacture of the valve assembly. To hold the spring in place, as the valve assembly is being withdrawn from the keg, the major spring 105 is simply force-fitted into place adjacent the dimples 113. This construction is one which is simpler to assemble and manufacture when compared to the valve assemblies of the past. This simplicity is obtained without loss in efficiency and with added operational advantages.

Incorporated in the improved embodiment shown in FIG. 6 is the uniquely configured valve insert 66*a* which is incorporated in valve member 109. This important improvement provides the added safety heretofore described should the keg be exposed to fire or other high temperature environments.

Also incorporated in the embodiment shown in FIG. 6 are the improved oppositely disposed keys 54 and the circumferentially displaced lugs 56 formed integrally with the valve with the valve body 101. These elements are configured identically to those shown in FIG. 3 and are also spaced apart in the manner shown. Thusly the added safety previously discussed is also achieved in the alternate embodiment illustrated in FIG. 6.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced herein.

I claim:

1. A valve sealing arrangement for sealing a container of fluid comprising:

(a) a valve assembly for providing access to said container;
(b) a valve assembly receiving member secured to said container;
(c) a deformable sealing member;
(d) said valve assembly having a body portion with a seal engaging surface and including a pair of diametrically opposed inwardly extending lugs;
(e) said sealing arrangement including a nonthreaded retaining member for insertion between said valve assembly and said receiving means for deforming and compressing said seal member between said seal engaging surface of said valve assembly and said receiving member for effecting a seal between said valve assembly and said receiving member;
(f) safety delay means for retaining said valve assembly within said receiving member when the container is under pressure should said retaining member become disengaged thereby allowing for gas to be released from the container prior to removal of said valve assembly, said safety delay means comprising:
(i) a pair of diametrically opposed keys carried by said body portion of said valve assembly, said keys being circumferentially spaced 90 degrees from said lugs; and
(ii) a pair of diametrically opposed offset keyways formed in said valve assembly receiving member, said keys being adapted to engage said keyways to prevent withdrawal of said valve assembly until rotated to a predetermined position after said retaining member has been withdrawn.

2. The valve sealing arrangement according to claim 1 wherein said valve assembly receiving member includes a top portion and a bottom portion, said top portion having means for receiving said retaining member and said bottom portion defining said seal engaging surface.

3. The arrangement according to claim 2 wherein said valve assembly receiving member defines an inner surface, said retaining member includes a resilient member cooperating with said inner surface above the top portion of said valve body when said retaining member is engaged with said inner surface the top portion of said valve body also engages said resilient member to hold the valve body in place.

4. The valve sealing arrangement according to claim 3 wherein said inner surface defines a groove substantially entirely around the periphery adjacent the top portion of the valve assembly receiving member and said resilient member is an expandable ring which expands into said groove leaving a portion exposed for engaging the top portion of said valve body.

5. The valve sealing arrangement according to claim 4 wherein said groove defines an upper lip and a lower lip and each of said diametrically opposed keyways includes a first portion extending downwardly through said upper lip but bound by said lower lip and a second portion offset circumferentially from said first portion extending upwardly through said lower lip but bound by said upper lip of said groove whereby said groove connects said first portion of said second portion and said keys carried by said valve member body are movable from said first portion to said second portion through said groove and from said second portion to said first portion through said groove.

6. A neck member for use with a container and a valve assembly for pressurizing fluid contained in said container and operating with said valve assembly to deliver fluid under pressure to a tapping mechanism attached to said valve assembly, comprising:
(a) a neck configured to receive a valve assembly wherein said neck includes an upper portion and a lower portion;
(b) said lower portion having a seal engaging surface;
(c) said upper portion having a receiving means for receiving a resilient retaining member;
(d) said valve assembly having a valve body, with a complementary seal engaging surface, a retaining member engaging surface and a pair of diametrically opposed lugs;
(e) said receiving means being located relative to said retaining member engaging surface to receive said retaining member in engageable relationship with said retaining member engaging surface of said valve body for maintaining said complementary seal engaging surface a predetermined distance from said seal engaging surface of said neck member and compressing a sealing member between said sealing surface and the complementary seal engaging surface to effect a seal between said valve assembly and said neck member and to secure said valve assembly in said neck member; and
(f) safety delay means for retaining said valve assembly within said neck when the container is under pressure should said retaining member become disengaged thereby allowing for gas to be released from the container prior to removal of said valve assembly, said safety delay means comprising a pair of diametrically opposed offset keyways formed in said neck adapted to engage diametrically opposed keys carried by said valve body and spaced 90 degrees from said lugs.

7. A valve assembly including a siphon tube extending therefrom for use with a container having a valve assembly receiving member exposed from the top of the container comprising:
(a) a valve body portion, having at least one lug, a first valve and a second valve, said first valve having a first valve seat and a first valve member for movement toward and away from said seat, said first valve member including an internally disposed metal valve insert of non-uniform wall thickness having a major diameter greater than the diameter of said first valve seat, said second valve including a second valve seat and a second valve member mounted for movement toward and away from said second valve seat;
(b) said siphon tube having a top portion and a bottom portion;
(c) a first biasing means engaging both said bottom portion of said siphon tube and said container for biasing said siphon tube so that said top portion with said first valve member is biased against said first valve seat for maintaining said first valve in a normally closed position;
(d) a non-threaded retaining member for retaining said valve assembly within the valve assembly receiving member; and
(e) safety delay means for retaining said valve assembly within the receiving member when the container is under pressure should said retaining member become disengaged thereby allowing for gas to be released from the container prior to removal of said valve assembly, said safety delay means including a pair of diametrically opposed keys carried by said valve body portion, at least one of said keys being circumferentially spaced from said lug.

8. The valve assembly according to claim 7 wherein said body portion includes a pair of diametrically opposed lugs and wherein said keys are circumferentially spaced from said lugs approximately 90 degrees.

9. The valve assembly according to claim 8 wherein said valve insert includes an increased wall thickness portion adjacent said first valve seat.

10. A fluid container comprising walls forming a substantially closed container capable of holding pressurized fluid; and a neck assembly mounted in one of said walls for use with a valve assembly for pressurizing fluid contained in said container and operating with the valve assembly to deliver fluid under pressure to a tapping mechanism attached to the valve assembly, said neck assembly including:

(a) a neck configured to receive a valve assembly wherein said neck includes an upper portion and a lower portion;

(b) said lower portion having a seal engaging surface;

(c) said upper portion having a receiving means for receiving a resilient retaining member and includes a pair of diametrically opposed keyways;

(d) said valve assembly having a valve body, with a complementary seal engaging surface and a retaining member engaging surface and including a pair of diametrically opposed keys adapted to be removably received in said keyways; and a pair of diametrically opposed lugs spaced from said keys approximately 90 degrees;

(e) said receiving means being located for receiving said retaining member in engageable relationship with said retaining member engaging surface of said valve body for maintaining said complementary seal engaging surface a predetermined distance from said seal engaging surface of said neck member and compressing a sealing member between said sealing surface and the complementary seal engaging surface to effect a seal between said valve assembly and said neck member and to secure the valve assembly in said neck member; and safety delay means for retaining said valve assembly within said receiving member when the container is under pressure should said retaining member become disengaged thereby allowing for gas to be released from the container prior to removal of said valve assembly.

11. The fluid container according to claim 10 wherein said valve assembly includes a first valve and a second valve, said first valve having a first valve seat and a first valve member formed of a yieldably resilient material having encapsulated therein a metal valve insert of non-uniform wall thickness having a major diameter greater than the diameter of said first valve seat and an increased wall thickness portion proximate said first valve seat.

* * * * *